US005103538A

United States Patent [19]

Ryder

[11] Patent Number: 5,103,538

[45] Date of Patent: Apr. 14, 1992

[54] NON-CORROSIVE SNAP FASTENER SYSTEM

[75] Inventor: Francis E. Ryder, Arab, Ala.

[73] Assignee: Ryder International Corporation, Arab, Ala.

[21] Appl. No.: 668,047

[22] Filed: Mar. 12, 1991

[51] Int. Cl.[5] ..... A44B 17/00

[52] U.S. Cl. ..... 24/662; 24/453; 52/410; 411/372

[58] Field of Search ..... 24/662, 324, 297, 453, 24/563, 701; 411/372, 373, 377, 910; 52/410; 135/119

[56] References Cited

U.S. PATENT DOCUMENTS

| | | | |
|---|---|---|---|
| 2,937,652 | 5/1960 | Zimmer, Jr. et al. | 135/119 |
| 3,416,200 | 12/1968 | Daddona, Jr. | 24/662 |
| 4,136,598 | 1/1979 | Hughes | 411/372 |
| 4,519,175 | 5/1985 | Resan | 52/410 |
| 4,601,624 | 7/1986 | Hill | 411/431 |
| 4,757,661 | 7/1988 | Hasan | 52/410 |
| 4,757,662 | 7/1988 | Gasser | 411/372 |
| 4,993,127 | 2/1991 | Mechem et al. | 24/453 |
| 4,999,963 | 3/1991 | Verble | 52/410 |

FOREIGN PATENT DOCUMENTS

| | | | |
|---|---|---|---|
| 8502447 | 6/1985 | European Pat. Off. | 411/910 |

*Primary Examiner*—Victor N. Sakran

*Attorney, Agent, or Firm*—Trexler, Bushnell, Giangiorgi & Blackstone, Ltd.

[57] ABSTRACT

A snap-fit fastener assembly including a receptacle member and a post member. The receptacle member is attachable to a first body such as a section of canvas or the like and the post member is attachable to a second body such as the side of a boat or the like. The receptacle member is a unitary single piece body integrally formed of a suitable plastic material and the post member includes an attachment portion and a head portion. Post engaging portions are integrally formed on the inside of the receptacle member for consistently, repeatably and securely engaging the post member in a snap-fit action such that the section of canvas may be retainably attached across the sides of the boat for covering the boat. A flexible arm with an upstanding protrusion is formed on the inside of the receptacle member for engaging a cooperatively formed groove formed on an underside of the head portion of the post member. A finger tab is formed on the outside of the receptacle member to facilitate engagement and disengagement of the receptacle portion to the post portion. The receptacle member is formed with a body portion and a cap portion connected by an integrally formed strap portion.

22 Claims, 3 Drawing Sheets

NON-CORROSIVE SNAP FASTENER SYSTEM

BACKGROUND OF THE INVENTION

This invention relates generally to the fastener art and more particularly to a snap-fit fastener assembly for attachment of a section of canvas or the like to an adjacent support structure.

Snap-fit fasteners are widely used and extremely important in the fastener art. Snap-fit fasteners provide a quick and efficient way to consistently and repeatably secure one body to another without additional tools.

A variety of snap-fit fasteners have been developed and are available for attaching one body to another and more specifically attaching a generally planar sheet member such as a section of canvas having a degree of stretch or elasticity to a generally rigid member or support structure. Many prior art fasteners incorporate two main components; a post attached to the rigid member, and a receptacle member securely attached to the generally planar sheet member or section of canvas.

The present invention was developed primarily for use with canvas covers or the like employed to cover boats or the like, and to overcome the shortcomings and disadvantages of prior art fastener systems as discussed hereinafter.

A first example of the prior art type of fastener system employs a split biasing ring retained inside of the receptacle portion attached to the cover. An inside diameter of the biasing ring is slightly smaller than an outside diameter of the post member. However, the post member is formed with a circumferential groove on the outside having a diameter generally less than or equal to the diameter of the biasing ring. The receptacle portion is engaged with the post portion by forcing the receptacle portion over the top of the post thereby expanding the biasing ring to enlarge the diameter thereof to force it over the top of the post. Once the receptacle is sufficiently forced over the post member the biasing ring engages the groove formed on the outside of the post member. A retaining fit is created when the biasing ring contracts into the annular groove formed on the post member. An example of this prior art design is illustrated in FIG. 9.

A second form of prior art fastening device employs a biasing member which is a formed spring pin. This second form of fastening device functions essentially in the same manner as the first form discussed hereinabove. The formed or split character of the spring clip permits the device to be designed for deeper spring clip/annular groove engagement. These first two types of fastener devices can be found in use on items ranging from clothing to boat covers.

A third form of fastening device functions to engage a sheet with a rigid member as described hereinabove but engages the receptacle member with a post member through an additional mechanical step. This type of fastening device is commonly called a "quarter-turn" locking device. The quarter turn device includes a post portion that has a locking member which is rotatable about an axis of the post. The post is axially inserted into an aperture formed in the receptacle portion and the locking portion is twisted one quarter turn to secure the receptacle portion onto the post. Typically, the locking portion and aperture are formed in cooperative irregular shapes such that a quarter turn of the locking portion prevents registration of the locking portion and the aperture thereby providing locking engagement.

A common problem with the prior art devices is that they typically are metallic and thus subject to corrosion, which is especially acute in salt water environments. Even if the metallic portions such as the biasing ring or spring clip are coated to prevent corrosion, repeated use of the clip either wears or flexes the coating off of the biasing portion thereby promoting corrosion. The problem with corrosion is that it stains or otherwise damages the canvas or sheet material used for the cover portion, and can become so sever as to prevent the fastener from functioning. Such characteristics are unacceptable for clothing or other visible applications. Also with these prior art designs is metal-to-metal contact between the post and the receptacle member which can and does result in galvanic action that accelerates corrosion. Here again the galvanic action which promotes corrosion is particularly strong in a salt water environment, where many canvas fastening systems are used.

A further problem with prior art devices is that a special tool must be employed to mount of assemble the receptacle portion with the cover or section of sheet material. Often a riveting operation is employed to crimp a lip portion of the receptacle portion through a hole formed in the cover material. The crimping operation requires time, training and specialized tools, and must be accurately performed in order to prevent cutting the material with an edge of the lip or damaging the fastener. This operation may damage the cover material and result in damaging the material thereby promoting pull out in which the receptacle disengages from the material portion when stresses are applied to the cover material.

Further, when a receptacle portion is damaged (for example through corrosion or impact) removal and replacement of the receptacle portion is very difficult and may in fact prevent reattachment of an identical receptacle portion. Since the receptacle portions are typically crimped onto the material as discussed above, removal may damage the cover material thereby enlarging the hole requiring a different receptacle portion to be used to replace the previous receptacle portion.

As an additional matter, once the receptacle portions are attached to the cover material and the posts are attached to the rigid material, such snaps are difficult to engage and disengage. Engagement difficulties arise because the cover material typically must be tensioned to engage the snap-fit fasteners. Tensioning of the material provides for a stronger cover which promotes protection of the covered area from environmental conditions as well as pre-stresses the covering material to prevent future sagging once the material naturally stretches. Since the receptacle portions of the snap lock fasteners have a generally low profile, they do not provide a convenient grip to engage or disengage the post members.

OBJECTS AND SUMMARY OF THE INVENTION

A general object of the present invention is to provide a two-piece snap-fit fastener assembly which is substantially non-corrosive to prevent damage to the material and the body to which components of the snap-fit fastener assembly are attached.

Another object of the present invention is to provide a snap-fit fastener assembly having a receptacle portion which may be quickly and easily attached to a section of cover or canvas material without using tools.

Yet another object of the present invention is to provide a snap-fit fastener assembly which employs only two components and no independent moving parts.

Still another object of the present invention is to provide a snap-fit fastener assembly in which engagement and disengagement of the receptacle portion with a corresponding post member is facilitated by integrally formed finger tabs.

A further object of the present invention is to provide a novel receptacle member that is formed of a suitable molded plastic material and can be employed with numerous types of post members, including those which may be installed on existing structures or boats.

Briefly, and in accordance with the foregoing, the present invention comprises a novel snap-fit fastener assembly. The fastener assembly of the present invention includes a receptacle portion and a post portion. The receptacle portion is a single piece body having at least a post receiving portion and a cover portion in the preferred embodiment integrally formed with the cover portion and also of a suitable plastic material. The receptacle portion is attachable to a portion of cover material and the post is attachable to a rigid member. The receptacle portion has integrally formed post engaging portions which consistently, repeatably and securely engage the post member to retain the cover material thereover. The cover portion of the receptacle portion is formed with a finger tab to facilitate engagement and disengagement of the receptacle portion to the post portion.

BRIEF DESCRIPTION OF THE DRAWINGS

The organization and manner of the operation of the invention, together with the further objects and advantages thereof, may be understood by reference to the following description taken in connection with the accompanying drawings in which like reference numerals identify like elements, and in which.

DESCRIPTION OF THE ILLUSTRATED EMBODIMENT

Figure 1:
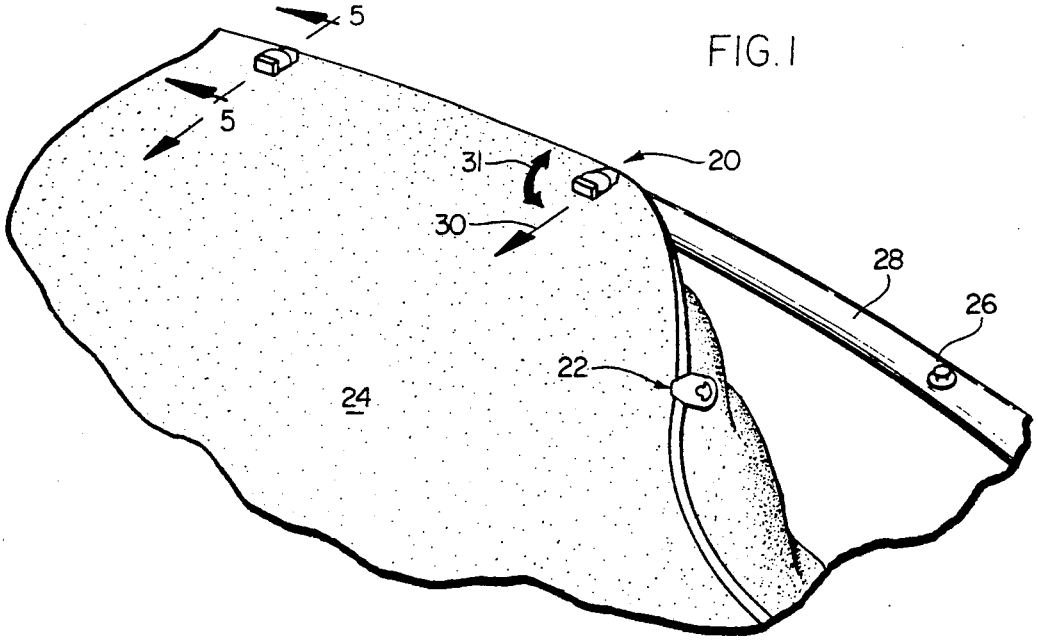
FIG. 1 is a perspective view of three receptacle port attached to a portion of a cover material in which two of the receptacles are engaged with post members attached to a rigid body and a third receptacle is disengaged from a corresponding post.

While this invention may be susceptible to embodiment in different forms, there is shown in the drawings and will be described herein in detail, a preferred embodiment with the understanding that the present disclosure is to be considered an exemplification of the principles of the invention, and is not intended to limit the invention to the embodiment illustrated and described herein.

It should be noted that dimensional relationships between members of the illustrated embodiment may vary in practice or may have been varied in the illustrations to emphasize certain features of the invention.

Referring now to the drawings, wherein parts are designated by the same numerals throughout the figures, a snap-fit fastener assembly 20 is shown in FIG. 1. As shown in FIG. 1, a receptacle member 22 of the snap-fit fastener assembly 20 is attached to a section of canvas or a first body 24 and a post 26 is attached to a second body 28 such as the rail of a boat. The first body 24 is a thin sheet like cover material which generally has a degree of elasticity. The second body 28 is a generally rigid member which provides rigid support for the post 26 which is attached thereto, with a head portion of the post 26 projecting for engagement by the receptacle member 22.

An example of the cover material 24 and rigid body 28 is a boat cover (cover material 24) attached to an outside edge or rail of a boat (rigid body 28) to protect the inside of the boat. As mentioned above, the cover material 24 preferably has some degree of elasticity such that when the cover 24 is attached to the rigid body 28 by means of the receptacle 22 engaged with the post 26, the cover 24 develops tensile forces (as indicated by arrow 30) which urge the receptacle member 22 into engagement with the post 26. Also as shown in FIG. 1, the receptacle 22 has a degree of swivel (as indicated by arrow 31) about the post 26 when engaged therewith. As will be described in further detail hereinbelow, the tensile forces 30 help to engage the receptacle member 22 with the post 26 to enhance the attaching characteristics of the interference fit fastener apparatus 20.

Figure 2:
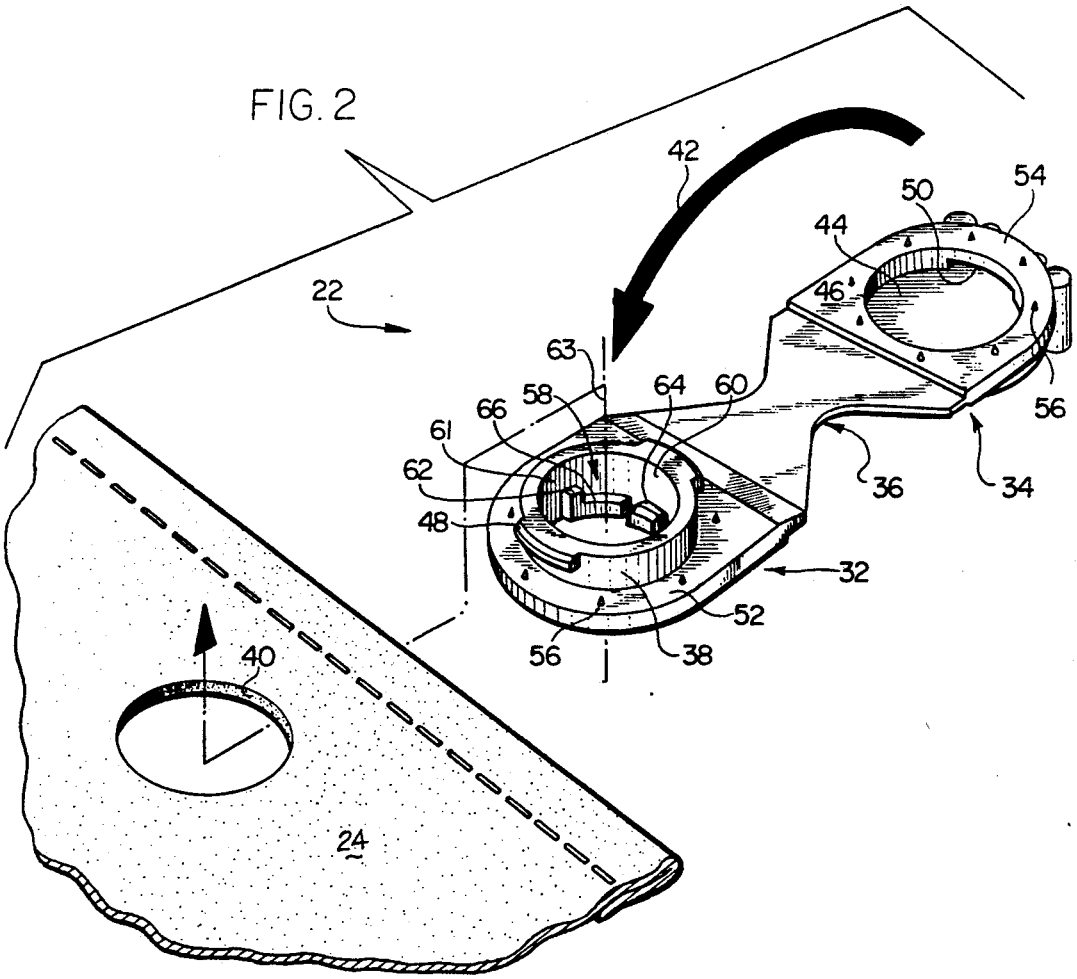
FIG. 2 is an enlarged perspective view of an integrally formed receptacle member positioned for engagement with a hole formed through a portion of canvas or cover material.

FIG. 2 provides a view of a preferred design or form of the receptacle member 22 prior to attachment to the cover material 24. The receptacle member 22 is formed with a post receiving body portion 32 and a cover or cap portion 34 connected therebetween by an integral web or strap 36. Engagement of the receptacle member 22 with the cover material 24 is achieved by inserting the neck portion 38 of the post receiving body portion 32 through a cooperatively sized and dimensioned hole 40 formed through the cover material 24. The receptacle member 22 operates in a clamshell-like fashion such that the integral web or strap 36 is flexed when the cap portion 34 is brought into engagement (as indicated by arrow 42) with the post receiving body portion 32 to clamp the cover material 24 therebetween, FIG. 5.

A cap recess 44 is formed in a surface 46 of the cap portion 34 abutting the post receiving portion 32 for engagement with the neck portion 38. Locking or snap-fit tabs 48 are formed on the neck 38 and are adapted to be engaged in cooperatively formed tab recesses 50 formed in the cap 34 to retain the cap 34 in engagement with the post receiving portion 32. A receiving portion shoulder 52 is formed on the body portion 32 and radially extends from the neck 38 of the post receiving portion 32. Similarly, a cap shoulder portion 54 is provided on the cap 34 and radially extends from the cap recess 44 of the cap portion 34. As will be described in further detail in FIG. 5, the shoulder portions 52, 54 are formed with upstanding cleats 56 which grip the canvas or cover material 24 when the cap 34 is snapped into place, FIG. 5, with the cover material 24 clamped therebetween.

Figure 3:
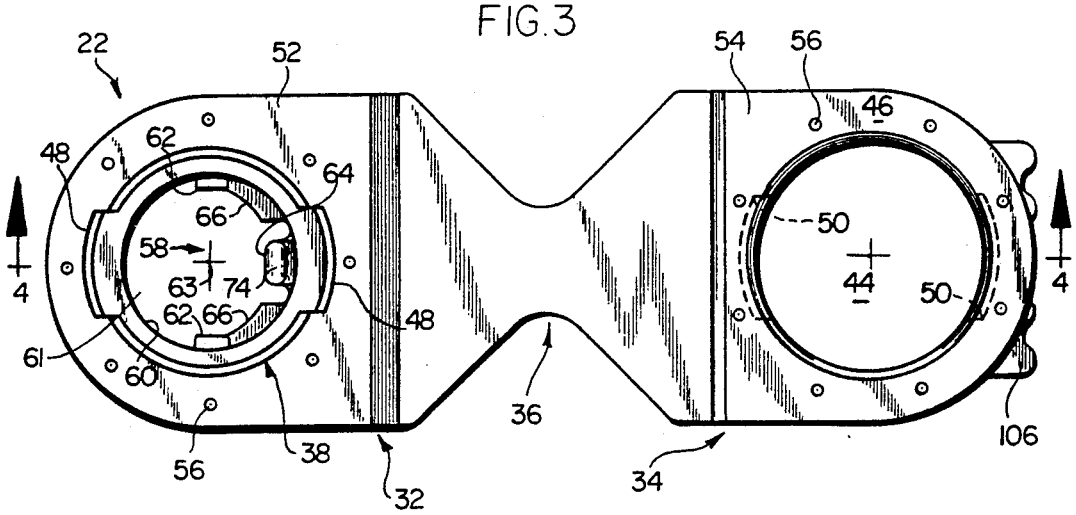
FIG. 3 is a plan view of an integrally formed receptacle member.

Post engaging means 58 are formed on an inside surface 60 of a bore 61 formed through the neck 38 in the body portion 32 to engagably retain the receptacle 22 in engagement with the post 26. A primary axis 63 extends through said bore 61. With reference to FIG. 3, the post engaging means 58 includes two opposedly spaced apart guide members 62, detent means 64 and two flange members 66. Each of the two flange support members 66 is positioned between one of the guide members 62 and the detent means 64. The function of these components in retaining the head of the post 26 within the bore 60 will be discussed in detail hereinbelow.

Figure 4:
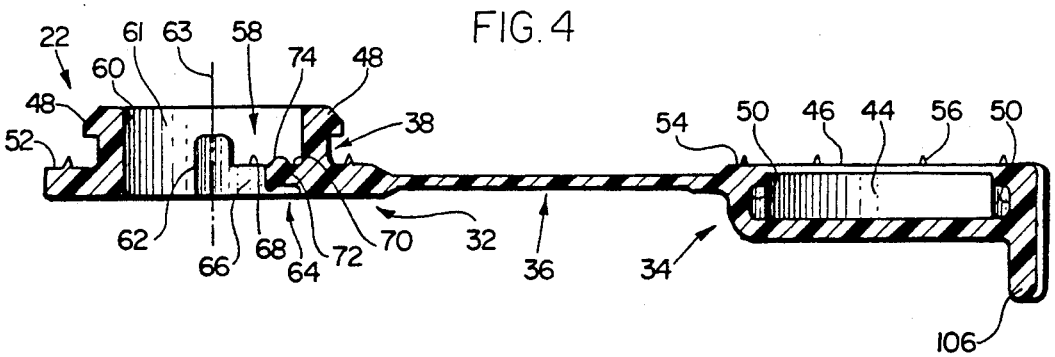
FIG. 4 is a cross-sectional view of the receptacle portion taken along the line 4—4 in FIG. 3.

FIG. 4 provides additional detail as to the shape and arrangement of the post engaging means 58. As shown, the flange 66 is attached to the guide member 62 and extends around the inside surface 60 of the bore 61 towards the detent means 64. A top surface 68 of the flange 66 is approximately level with a top surface 70 of a flexible arm portion 72 of the detent means 64. A protuberance 74 is formed on the top surface 70 of the arm 72 of the detent means 64.

Figure 5:
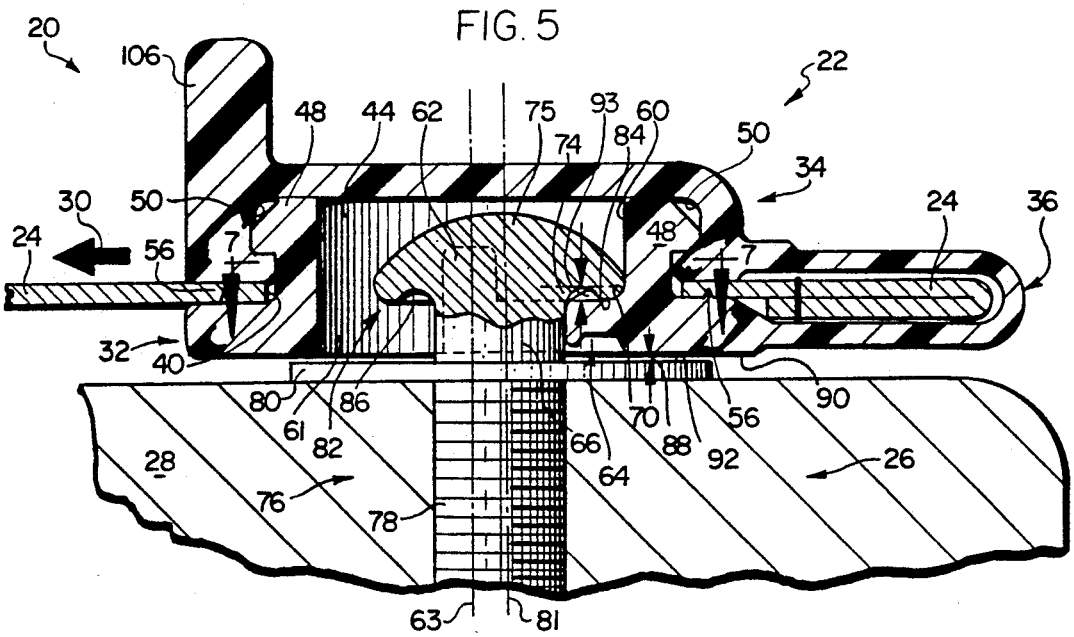
FIG. 5 is an enlarged partial cross-sectional view of a receptacle portion attached to a portion of cover material and in which the receptacle portion is engaged with a post member.

FIG. 5 illustrates the snap-fit fastener assembly 20 of the present invention showing the receptacle member 22 engaged with the post 26 and also the cap 34 snapped in position on the body portion 32 to mount the member 22 to a section of canvas 24. The post 26 is formed with a head portion 75 and an attachment portion 76. The head portion 75 is engaged with the receptacle portion 22 to retain the cover material 24 in engagement with the second body 28. The attachment portion 76 of the post 26 is shown as a threaded shank portion 78 and a collar flange 80. The collar flange 80 is coaxial with the shank 78 along a central axis 81 and limits the depth which the threaded shank portion 78 is driven into the rigid body 28 thereby assuring that the head portion 75 extends a required distance above the rigid body 28 to permit proper engagement with the receptacle portion 22.

As further shown in FIG. 5, the cap portion 34 is engaged with the post receiving portion 32 and retains or clamps a portion of the cover material 24 therebetween. The cleats 56 are at least slightly forced or embedded into the cover material 24 and grip the cover material 24 to retain engagement therewith and to prevent enlargement of the hole 40 formed therein and pull-out of the receptacle member 22 therefrom. Forceful engagement of the cleats 56 with the cover material 24 and the clamping of said cover material between the opposed shoulders 52 and 54 is enhanced and maintained by engagement of the locking tabs 48 within the corresponding tab recess 44 in cap 34. Once the receptacle member 22 is engaged with the post 26, the cap portion 34 shields the head 75 of the post 26. It should be noted that the cap portion 34 is necessary to the extent of engagably mounting the receptacle member 22 on the cover material 24 and it does not function to retain the receptacle member 22 in engagement with the post 26.

The head 75 has a shoulder 82 formed underneath and radially extending from the threaded shank 78 with an annular protuberance 84 formed thereon. The annular protuberance 84 is formed on the shoulder 82 spaced a distance away from the threaded shank forming an annular groove 86 therebetween. The annular protuberance 84 and annular groove 86 cooperatively engage the protuberance 74 formed on the top surface 70 of the arm 72 of the detent means 64 of the post engaging means 58. A dimension 88 between a bottom surface 90 of the post receiving body portion 32 and a top surface 92 of the collar flange 80 is at least slightly smaller than a height 93 of the protuberance 74. Because the dimension 88 is at least slightly less than the height 93 of the protuberance 74, the flexible arm portion 72 of the detent means 64 is forcibly flexed into engagement with the protuberance 74 will be received in the annular protuberance 84 and the annular groove 86 formed on the shoulder 82.

Figure 7:
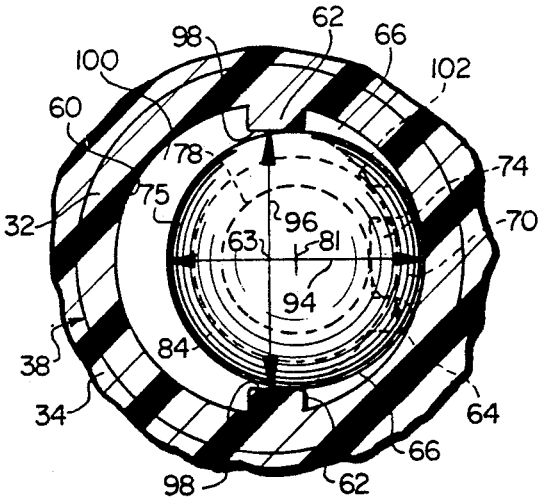
FIG. 7 is a partial cross-sectional view taken along line 7–7 in FIG. 5 wherein a head portion of the post member is engaged with post engaging means of the receptacle portion.

FIG. 7 provides a partial plan view in cross-section of the snap-fit fastener apparatus 20 as illustrated in FIG. 5. As shown, the head portion 75 has a diameter 94 which is generally equal to a dimension 96 measured between opposed faces 98 of the guide members 62. Tensile forces created in the cover material 24 help to retain the head in engagement with the post engaging means 58 and prevent the head 75 from moving back through the opening 96 between the guide members 62. An entry cavity 100 is generally defined by the area in the bore 61 opposite the post engaging means 58 and offset from the center 63 of the bore 32. The entry cavity 100 is sized and dimensioned to receive the head portion 75 without resistance. A retention cavity 102 is generally defined by the area between the guide members 62 in which the post engaging means 58 are formed. As shown in FIG. 7 and with additional support from FIG. 5, the annular protuberance 84 formed on the shoulder 82 of the head 75 abuts the top surface 68 of the flange 66. This engagement helps to prevent the receptacle member 22 from being pulled off of the post along the central axis 81.

Figure 10:
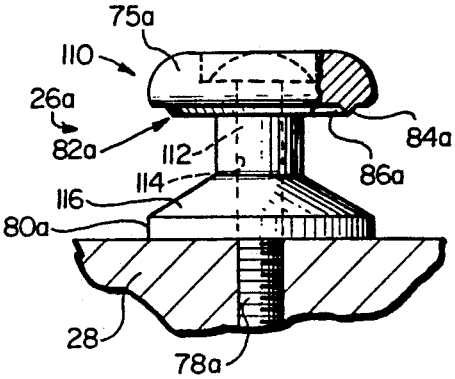
FIG. 10 is an elevational view of an alternative post member including a fastener and a plastic collar.

An alternative post member **26*a* is illustrated in FIG. 10. The post member 26*a* includes a plastic collar member 110 and an independent fastener 112 retained in a bore 114 formed through the collar member 110. The collar member 110 includes an integral head 75*a* and collar flange 80*a*. An integral annular protuberance 84*a* and annular groove 86*a* are formed on a shoulder 82*a* on the underside of the head 75*a*. A sloped ramp 116 is formed on a top surface of the collar flange 80*a* to facilitate engagement of the post engaging means 58 with the post 26*a*. The post 26*a* has the advantage of providing a uniform collar member 110 which engages the post receiving means 58 in a desired manner which can be mounted to a rigid member 28 using a range of suitable fasteners 112**.

Figure 6:
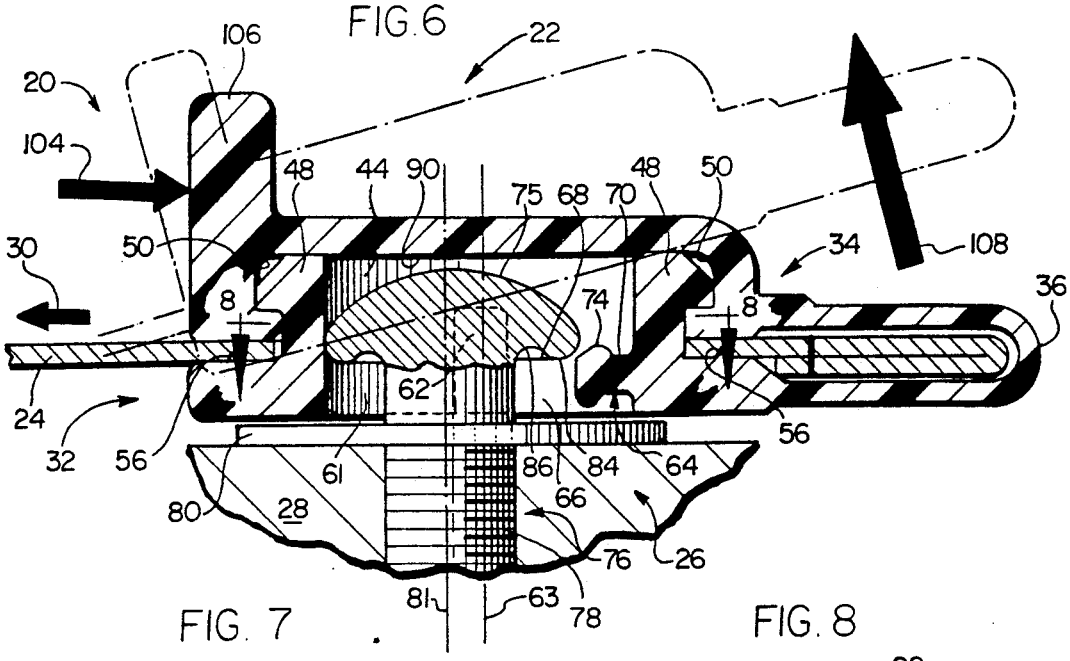
FIG. 6 shows the cross-sectional view shown in FIG. 5 illustrating disengagement of the receptacle portion from the post member and, in phantom line, removal therefrom.
Figure 8:
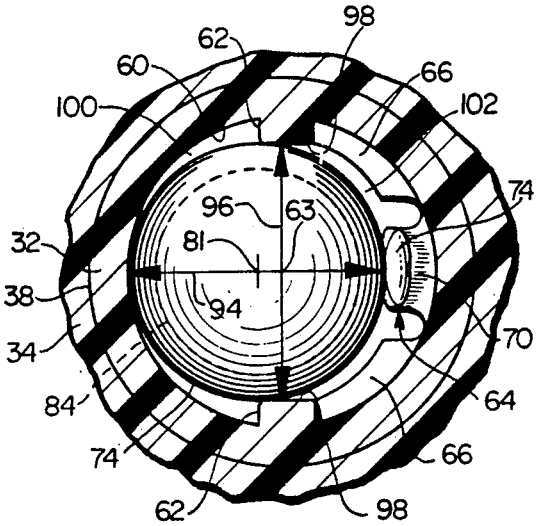
FIG. 8 is a partial cross-sectional view taken along the line 8—8 in FIG. 6 in which the head portion of the post member is disengaged from the post engaging means integrally formed in the receptacle portion.
Figure 9:
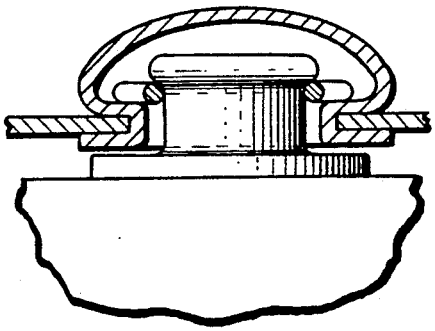
FIG. 9 PRIOR ART
FIG. 9 is a partial, cross-sectional view of a prior art snap-fit fastener device.

The receptacle member 22 is disengaged from the post 26 as illustrated in FIGS. 6 and 8. As shown in FIG. 6, a force (as indicated by arrow 104) is applied to a finger tab 106 sufficient to overcome the tension 30 in the cover material 24 on the head 75 and to slide the receptacle member 22 to the right as viewed. Application of force 104 to the finger tab 106 forces the annular protuberance 74 to disengage from the groove 86 and moves the head 75 out of the retention cavity 102 between the dimension 96 measured across the guide member 62 and into the entry cavity 100. Once the head 75 is positioned in the entry cavity 100, a force as indicated by arrow 108 is applied to the folded integral web 36 to lift the receptacle member 22 off of the head 75. It should be noted that force 104 may be applied to the finger tab 106 when engaging the receptacle member 22 with the post 26 in order to stretch the cover material 24. More specifically, initial engagement would be opposite to the operation described, that is, the head 75 of post 26 is initially disposed within the entry cavity 100 to attain the condition as shown in FIG. 6. Next, the tab 106 s used to slide the receptacle member 22 to the left as viewed in FIG. 6 to attain the engagement condition as illustrated in FIG. 5. It can be appreciated that the tension 30 in the canvas or sheet material 24 will serve to maintain the engaged condition of FIG. 5.

In use, the snap-fit assembly 20 of the present invention includes a receptacle member 22 engagable with the post member 26. The receptacle member 22 is illustrated as a unitary one piece molded plastic member including a post receiving portion 32 and a cap portion 34 connected by an integral web 36. As an alternative embodiment, the integral web 36 may be eliminated resulting in a two-piece receptacle member which is not limited by the integral web 36.

A hole 40 is formed through the cover material 24 for receiving the neck 38 of the post receiving portion 32. Once the neck 38 is inserted through the hole 40, the cap portion 34 is folded over the post receiving portion 32 to engage the tab recesses 50 formed in the cap recess 44 with the locking tabs 48 formed on the neck 38 and clamp the cover material 24 therebetween. Thus attached to the cover material 24, the receptacle portion 22 may be retainably engaged with the post 26. More specifically, the bore 61 formed in the post receiving portion 33 is engaged with the head 75 of the post 26.

The receptacle member 22 is forced in the direction as indicated by arrow 104 by gripping the tab 106 to position the entry cavity 100 in axial alignment with the head 75 of the post 26. Once aligned, the receptacle member 22 is lowered into engagement with the head 75 whereupon tension 30 developed in the cover material 24 move the receptacle portion 22 into engagement with the head 75 and contribute to retaining the receptacle member 22 in engagement in the retention cavity 102. If the tension 30 is insufficient to engage the head 75, an external force may be applied to the receptacle member 22 to engage the head 75 with the post engaging means 58 formed in the retention cavity 102.

The first retaining portion of the post engaging means 58 to affect the post 26 is the pair of opposed guide members 62 which are spaced apart with a dimension therebetween 96 which is generally equal to the diameter 94 of the head 75. As the head 75 is moved into the retention cavity 102, an annular protuberance 84 contacts a protuberance 74 formed on the top surface 70 of the flexible arm 72. When sufficient forces are applied, the flexible arm 72 flexes downwardly and the protuberance 74 detents into engagement with the annular groove 86. The combination of the post engaging means 58 and the tensile forces 30 act to retain the receptacle member 22 on the post 26. Axial removal of the receptacle member 22 from the post 26 is prevented by flanges 66 formed between the interference members 62 and the detent means 64 which engage the shoulder 82 of the head 75.

Disengagement of the receptacle member 22 from the post 26 is accomplished by reversing the steps which were followed to engage the receptacle member 22 with the post 26.

Cleats 56 are provided on the receiving portion shoulder 52 and the cover shoulder portion 54 and are alternately spaced apart to engage the cover material 24 positioned therebetween. Replacement of the receptacle member 22 is easily accomplished if the receptacle member 22 becomes disengaged or pulled out of the cover material 24. Replacement is effected by engaging a new receptacle member 22 with the existing hole 40 as noted above. Replacement of receptacle members 22 is easily accomplished without special tools such as rivet-type crimping tools.

The post 26 may be formed with a driving head to facilitate use of a drive tool to install the post 26 in the rigid body 28. Since the receptacle member 22 and post 26 may be easily formed of a suitable plastic material, the interference fit fastener 20 is corrosion resistant even under corrosion promoting conditions such as a salt water environment.

While a preferred embodiment of the present invention is shown and described, it is envisioned that those skilled in the art may devise various modifications of the present invention without departing from the spirit and scope of the appended claims.

The invention is claimed as follows:

1. A fastener assembly for attaching a portion of a first sheet like body such as a section of canvas or the like to a second body, said fastener assembly comprising a receptacle member for attachment to a section of canvas and a post member attachable to said second body, said post member including a mounting portion and a head portion for disposition in said receptacle member; said receptacle member comprising a molded component including a body portion defining a bore for receiving said head portion therethrough and post engaging means in said bore integral with said molded body portion for releasably engaging said head portion of said post member with a snap-fit action to retain said post member in said bore, removal of said post member from said bore requiring disengagement of the snap-fit action between said head portion of said post member and said post engaging means.

2. A fastener assembly according to claim 1, wherein said receptacle member further includes means for mounting said receptacle member to said first body portion, said means being integral with said molded body component.

3. A fastener assembly according to claim 2, wherein said means for attaching the receptacle member to said section of canvas comprises a strap member integral with said body portion and a cap formed on the end of said strap member engageable about the exterior of said body portion with a snap-fit action, said strap member being folded over for engaging said cap with said body portion to clamp a section of canvas between said body portion and said cap portion while said strap encompasses an adjacent portion of said section of canvas.

4. A fastener assembly according to claim 1, wherein said post engaging means is formed as a unitary one piece body with said body portion.

5. A fastener assembly according to claim 1, further including detent means formed on a surface of said bore for engaging said head portion of said post member.

6. A fastener assembly according to claim 5 wherein said detent means further includes a flexible arm extending from said bore, a protuberance extending from a top surface of said flexible arm, an annular groove projecting into the underside of said head portion engagable with said protuberance providing relative rotation of said receptacle member about said post member when engaged therewith.

7. A fastener assembly according to claim 1 wherein said post engaging means further include: opposed guide members formed on said bore, said guide members receiving said head portion therebetween and guiding said head portion into engagement with said detent means; flange members formed on an inside surface of said bore, said flange members abutting an underside of said head portion for preventing axial disengagement of said receptacle member from said post member once engaged therewith.

8. A fastener assembly according to claim 1 wherein said post engaging means formed inside of said bore releasably retain said head portion positioned in said bore with a snap-fit action, said head being postionable into said receptacle member in a first or vertical direction and slidably engaging said post engaging means in a second or horizontal direction, removal of said head from said bore requiring disengagement of said post engaging means from said head portion.

9. A fastener assembly for attaching a portion of a first body such as a section of canvas or the like to a second body, said fastener assembly comprising: a receptacle member attachable to said first body, and a post member attachable to said second body, said post member including an attachment portion and a head portion; said receptacle member comprising a body portion and a post receiving portion defining a bore for receiving said head portion and said post receiving portion of said post member therein, post engaging means formed inside of said bore for releasably retaining said head portion positioned in said bore in engagement therewith by a snap-fit action, said head portion being postionable into said receptacle member in a first or vertical direction and slidably engaging said post engaging means in a second or horizontal direction, removal of said head portion from said bore requiring disengagement of said post engaging means from said head portion and a cap portion, said post receiving portion and cap portion being engagable for retaining a portion of a section of canvas therebetween.

10. A fastener assembly according to claim 9 wherein said post engaging means includes a flexible arm extending from said bore for engaging said head portion of said post member.

11. A fastener assembly according to claim 10 wherein said post engaging means further including: opposed guide members on said bore, said guide members being spaced apart and receiving said head portion of said post member therebetween, said head portion being guided into engagement with said flexible arm in said bore; at least one flange member formed on an inside surface of said bore generally positioned between said guide members, said at least one flange member resisting axial removal of said head portion from said receptacle member once engaged therewith.

12. A fastener assembly according to claim 9 wherein one of said post receiving portion and cap portion is integrally formed with locking tabs projecting therefrom and the other of said post receiving portion and said cap portion is integrally formed with cooperative recesses for receiving said locking tabs therein, said locking tabs being engagable with said recesses for retaining said cap portion and said post receiving portion in engagement.

13. A fastener assembly according to claim 9 further including first and second shoulder portions formed with and radially extending from said post receiving portion and said cap portion, spaced apart cleats formed on opposing surfaces of said first and second shoulder portions, said cleats projecting away from each of said shoulder portions towards the opposing shoulder portion such that when said cap portion and said post receiving portion are engaged said cleats retainably clamp a portion of a section of canvas positioned therebetween.

14. A fastener assembly according to claim 8 wherein a finger tab is integrally formed on an exterior surface of said receptacle member for gripping said receptacle member when said receptacle member is being attached to or removed from said post member, said finger tab being formed to provide a mechanical advantage when engaging and disengaging said receptacle portion and said post.

15. A fastener assembly for attaching a portion of a first sheet like body such as a section of canvas or the like to a second body, said fastener assembly comprising a receptacle member for attachment to a section of canvas and a post member attachable to said second body, said post member including a mounting portion and a head portion for disposition in said receptacle member; said receptacle member comprising a molded component including a body portion defining a bore for receiving said head portion and post engaging means integral with said molded body portion in said bore for releasably engaging said post member to retain said post member in said bore with a snap-fit action, removal of said post member from said bore requiring disengagement of the snap-fit action, a retention cavity formed in said bore including detent means formed on a surface thereof for engaging said head portion of said post member, said detent means further includes a flexible arm extending from said bore, a protuberance extending from a top surface of said flexible arm, an annular groove projecting into the underside of said head portion engagable with said protuberance providing relative rotation of said receptacle member about said post member when engaged therewith.

16. A fastener assembly for attaching a portion of a first sheet like body such as a section of canvas or the like to a second body, said fastener assembly comprising a receptacle member for attachment to a section of canvas and a post member attachable to said second body, said post member including a mounting portion and a head portion for disposition in said receptacle member; said receptacle member comprising a molded component including a body portion defining a bore for receiving said head portion and post engaging means integral with said molded body portion for releasably engaging said post member to retain said post member in said bore with a snap-fit action, removal of said post member from said bore requiring disengagement of the snap-fit action, a retention cavity formed in said bore including detent means formed on a surface thereof for engaging said head portion of said post member, said post engaging means further including opposed guide members formed on said bore, said guide members receiving said head portion therebetween and guiding said head portion into engagement with said detent means; flange members formed on an inside surface of said bore, said flange members abutting an underside of said head portion for preventing axial disengagement of said receptacle member from said post member once engaged therewith.

17. A fastener assembly for attaching a portion of a first body such as a section of canvas or the like to a second body, said fastener assembly comprising: a receptacle member attachable to said first body, and a post member attachable to said second body, said post member including an attachment portion and a head portion; said receptacle member comprising a body portion and defining a bore for receiving said head portion of said post member therein, post engaging means formed inside of said bore for releasably retaining said head portion positioned in said bore in engagement therewith by a snap-fit action, said head portion being positionable into said receptacle member in a first or vertical direction and slidably engaging said post engaging means in a second or horizontal direction, removal of said head portion from said bore requiring disengagement of said post engaging means from said head portion, said post engaging means includes a flexible arm extending from said bore for engaging said head portion of said post member, a protuberance extends from a top surface of said flexible arm and a recess projects into an underside of said head for selectively engaging said protuberance on said flexible arm.

18. A fastener assembly according to claim 17 wherein said recess is an annular groove projecting into the underside of said head portion for providing relative rotation of said receptacle member about said post member when engaged therewith.

19. In combination, a section of a sheet like body with an opening and a fastener assembly attachable to said sheet like body through said opening, said fastener assembly attaching a portion of said sheet like body to which said fastener is attached to a second body; said fastener assembly comprising a receptacle member insertable through said opening in said sheet like body and a post member attachable to said second body, said post member including a mounting portion and a head portion for disposition in said receptacle member; said receptacle member comprising a molded component including a body portion defining a bore for receiving said head portion therethrough and post engaging means in said bore integral with said molded body portion for releasably engaging said head portion of said post member with a snap-fit action to retain said post member in said bore, removal of said post member from said bore requiring disengagement of the snap-fit action between the head portion of the post member and the post engaging means.

20. A fastener assembly according to claim 19 wherein said post engaging means further includes a flexible arm extending from said bore, a protuberance extending from a top surface of said flexible arm, an annular groove protuberance engaging said annular groove in a snap fit action for retaining said head in engagement with said receptacle portion.

21. A combination according to claim 19 wherein said receptacle member includes means for mounting said receptacle member to said sheet like body, said means being integral with said molded body component, said means for attaching said receptacle member to said sheet like body comprises a strap member integral with said body portion and a cap formed on the end of said strap member engagable about the exterior of said body portion with a snap-fit action, said strap member being folded over with a portion of said sheet like body therebetween for engaging said cap with said body portion to clamp said portion of said sheet like body between said body portion and said cap portion, said strap member being sufficiently long to circumscribe an adjacent portion of said sheet like body between said opening and an edge thereof.

22. A combination according to claim 21 further including first and second shoulder portions formed with and radially extending from said receptacle portion and said cap portion, spaced apart cleats formed on opposing surfaces of said first and second shoulder portions, said cleats projecting away from each of said shoulder portions towards the opposing shoulder portion such that when said cap portion and said receptacle portion are engaged said cleats retainably clamp a portion of said sheet like body located around said opening therethrough positioned therebetween.

* * * * *

UNITED STATES PATENT AND TRADEMARK OFFICE

CERTIFICATE OF CORRECTION

PATENT NO. : 5,103,538

DATED : April 14, 1992

INVENTOR(S) : Francis E. Ryder

It is certified that error appears in the above-identified patent and that said Letters Patent is hereby corrected as shown below:

Claim 20 Column 12, line 14 "annular groove protuberance" should read -- annular groove projecting into the underside of said head portion, said protuberance --

Signed and Sealed this

Third Day of August, 1993

*Attest:*

Michael K. Kirk

MICHAEL K. KIRK

*Attesting Officer*

*Acting Commissioner of Patents and Trademarks*